US005295303A

United States Patent [19]

Ogawa et al.

[11] Patent Number: 5,295,303

[45] Date of Patent: Mar. 22, 1994

[54] METHOD OF MAKING A CORRUGATED FIN

[75] Inventors: Yuji Ogawa, Handa; Yoshitaka Kuroda, Anjo; Yasuo Abe, Kariya, all of Japan

[73] Assignee: Nippondenso Co., Ltd., Kariya, Japan

[21] Appl. No.: 865,281

[22] Filed: Apr. 8, 1992

[51] Int. Cl.[5] ..... B21D 5/14; B21D 13/04

[52] U.S. Cl. ..... 29/890.049; 72/180; 72/385; 72/414

[58] Field of Search ..... 72/181, 180, 182, 178, 72/414, 385, 415; 29/890.049, 890.046, 890.045

[56] References Cited

U.S. PATENT DOCUMENTS

| | | | |
|---|---|---|---|
| 2,343,126 | 2/1944 | Matlat | 72/180 |
| 2,701,000 | 2/1955 | Colvin | 72/181 |
| 2,948,325 | 8/1960 | Welindt | 72/415 |
| 3,197,975 | 8/1965 | Boling | 29/890.046 |
| 4,233,833 | 11/1980 | Balinski | 72/385 |
| 4,317,350 | 3/1982 | Sivachenko | 72/180 |
| 4,505,419 | 3/1985 | Steeb | 29/890.046 |
| 4,770,018 | 9/1988 | Bosl | 72/181 |
| 5,056,348 | 10/1991 | Albrecht | 72/180 |

FOREIGN PATENT DOCUMENTS

| | | |
|---|---|---|
| 58-184002 | 10/1983 | Japan . |
| 62-212025 | 9/1987 | Japan . |

*Primary Examiner*—Daniel C. Crane
*Attorney, Agent, or Firm*—Cushman, Darby & Cushman

[57] ABSTRACT

The strip 2 is inserted between forming rollers 1*a* and 1*b* so that fins 3 are formed on the strip 2. The forming rollers 1*a* 1*b* have a line of protrusion protruding radially on the periphery thereof and the protrusion of one roller mates with protrusion of the other roller. A pair of forming rollers or more pairs of forming rollers are employed. A part of the strip 2 sandwiched between side face portions 13*a* and 14*a* of the protrusion 13 and 14 is pressed in the direction of the thickness of the strip with a stress between yield stress and maximum stress of the strip 2. To adjust the stress, a clearance G between protrusions is controlled.

12 Claims, 10 Drawing Sheets

METHOD OF MAKING A CORRUGATED FIN

BACKGROUND OF THE INVENTION

This invention relates to a method of forming fins on a strip. This fin strip is then inserted into a flat tube for a heat exchanger and brazed.

Conventionally, there are three methods of forming a corrugated plate from a strip with rollers. The first method is shown in FIG. 13. A strip 60 is advanced by rotation of plural pairs of rollers, including upper rollers 31 and 33 and lower rollers 32 and 34, so that a fin 61 is gradually formed on the strip 60.

The upper rollers 31 and 33 have protrusions 31*a* and 33*a* which protrude radially with respect to the axis of rotation along their circumferences and the lower rollers 32 and 34 have matrix depressions 32*a* and 34*a* which mate with the protrusions 31*a* and 33*a* through clearances along their outer circumferences. The thickness of the strip is almost the same before and after the process.

The second method of forming such a plate is shown in FIG. 14. An upper roller 41 and a lower roller 42 having a plurality of protrusions vary the thickness of the strip 60 in the direction of width with one or two steps of the process so that fins 62 are formed on the strip 60. This method is disclosed in Japanese patent application laid open (KOKAI)62-212025.

The third method is shown in FIG. 15. The strip 60 is put between gears 51 and 52 which have almost the same length as the width of the strip 60 so that a corrugated plate is formed at one time. This method is disclosed in Japanese patent application laid open (KOKAI)43-29307.

However, each of the above methods have their own defects. In the first method, the number of paired upper and lower rollers become large so that the number of steps of the manufacturing process increases. In the second method, tensile stress beyond the yield stress is applied to cause residual extensional deformation so that a corrugated plate is formed. However, to form accurate corrugations with a flat plate having equal thickness is generally completed only when a sine wave corrugation having low height against the pitch of the wave is required. If the rectangular corrugation is required, the corrugated plate partially loses its thickness and may rupture. In the third method, if the length b of fins 63 in FIG. 15 is required to change a strip 60 which has a width to cover the change and further rollers 51 and 52 which have a length to cover the change are required so that flexibility for responding variation of fin length b becomes small.

The object of this invention is to provide a method of forming fins which makes a manufacturing process simple, which does not cause the strip to be ruptured at the time of process and which easily obtains production having requested length.

SUMMARY OF THE INVENTION

To complete such an object, the present invention adopts a method of forming fins by inserting a strip between a pair of forming rollers. The pair of forming rollers has protrusions in-line on an outer face perpendicular to the axis of rotation. The protrusions on the periphery of a pair of the rollers is formed to mate each other. Further, a clearance between protrusions of an upper roller and protrusions of a lower roller is adjusted to press a part of the strip which is sandwiched by a pair of side faces of the protrusions with a stress between yield stress and maximum stress of the strip.

The strip is pressed by a pair of side faces of the protrusions in the direction of thickness of the strip with a stress between yield stress and maximum stress of the strip so that fins do not rupture. Further, fins keep predetermined equal thickness and normal shape.

The present above structure has the following superior effects:

(a) Time for the manufacturing process becomes short.

(b) The stress that is pressing fins is some amount between yield stress and maximum stress. This means that fins do not rupture and formed products are always stable.

(c) A cross-sectional area of the strip is almost the same before and after forming and the thickness of the strip after forming is even.

DETAILED DESCRIPTION OF THE PREFERRED EMBODIMENT

Figure 1:
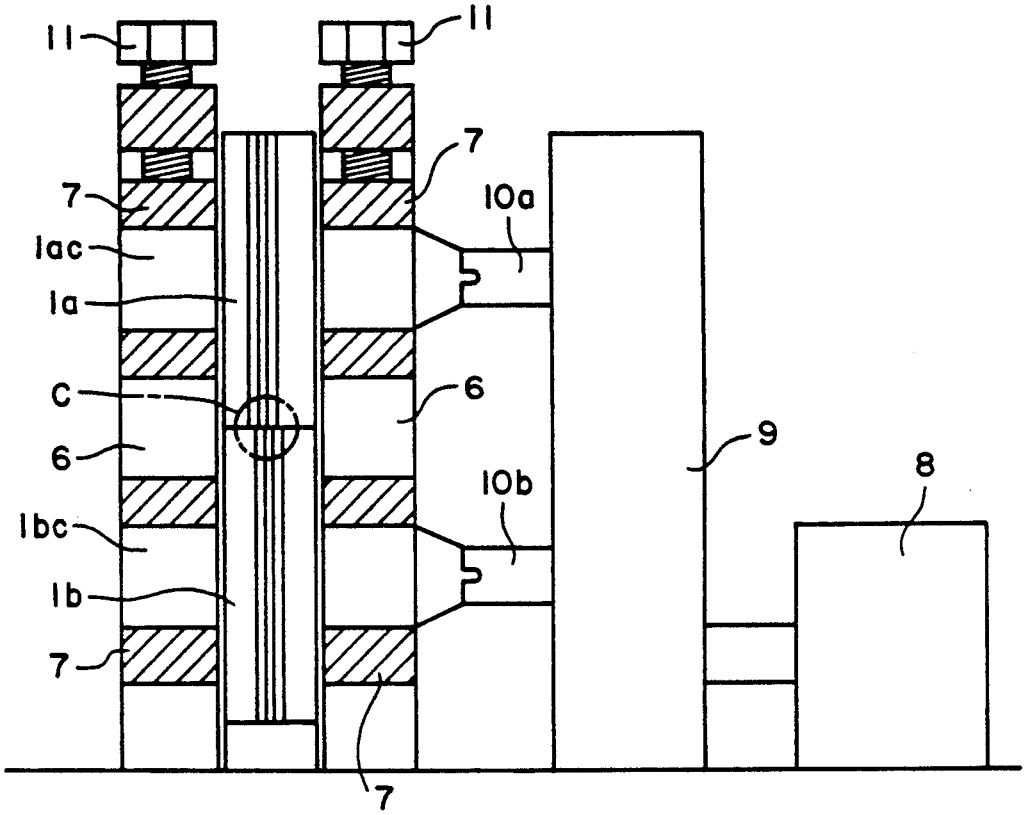
FIG. 1 is an elevational view of an apparatus for forming fins which is employed in the first embodiment.

The first embodiment is shown in FIG. 1 through FIG. 8. A fin-forming apparatus employed by the present invention is shown in FIG. 1. A pair of fin-forming rollers 1*a* and 1*b* are rotatably supported by bearings 7 installed in bearing support frame 6 through the axes of rollers 1*ac* and 1*bc*. Each roller has protrusions and depressions which are both formed on outer periphery of each roller. protrusions of one roller mate with depressions of the other roller. Rotative driving force for fin-forming rollers 1*a* and 1*b* is obtained to convert driving force of a motor 8 into biaxial output and to transmit the biaxial output to the axes of rollers 1*ac* and 1*bc* through universal joints 10*a* and 10*b*. The driving force of the motor 8 is converted into a biaxial output which rotates one another at the same speed but opposite direction by a synchronous gear mechanism. Bolts 11 adjust center distance by adjusting a clearance between forming rollers 1*a* and 1*b*. The clearance is stated below.

Figure 2:
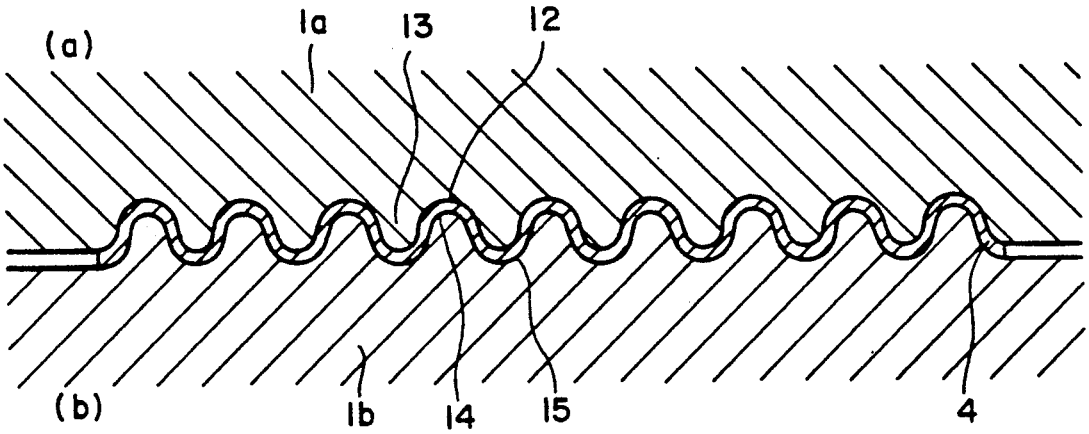
FIG. 2 is an enlarged sectional view of portion C in FIG. 1.

FIG. 2 is an enlarged sectional view of portion C in FIG. 1. A line of protrusion 13 and a line of depression 12 are disposed alternately on the peripheral face of the forming roller 1*a*. The protrusion 13 protrudes radially. The depression 12 depression radially. A line of protrusion 14 and a line of intrusion 15 are also disposed alternately on the peripheral face of the forming roller 1*b*. A line of protrusion 13 and a line of protrusion 14 mate with a line of depression 15 and a line of depression 12 respectively. The rollers 1*a* and 1*b* are perpendicular to their axes 1*ac* and 1*bc* respectively. The strip 2 is inserted into the clearance between the protrusion and depression of forming rollers 1*a* and 1*b*.

Corrugated plate 4 is produced when the roller axes 1*ac* and 1*bc* are driven. The strip 2 is prevented from extending in the direction of the width by the rollers 1*a* and 1*b*. The thickness of the strip 2 becomes thin after corrugated plate is formed. The width of the strip 2 remains almost the same. Further, a cross-sectional area of the strip 2 is almost the same before and after the formation.

Figure 3A:
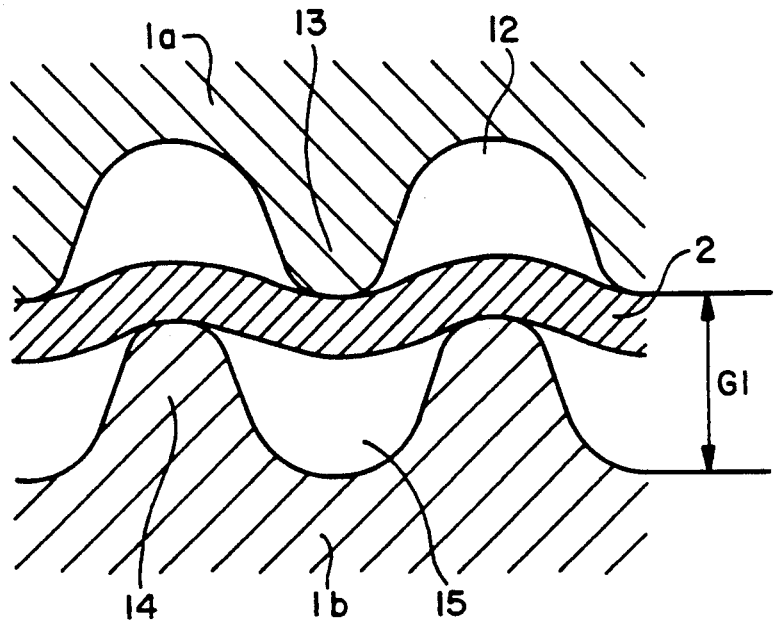
FIGS. 3(*a*), 3(*b*) and 3(*c*) are sectional views forming process of fins.
Figure 3B:
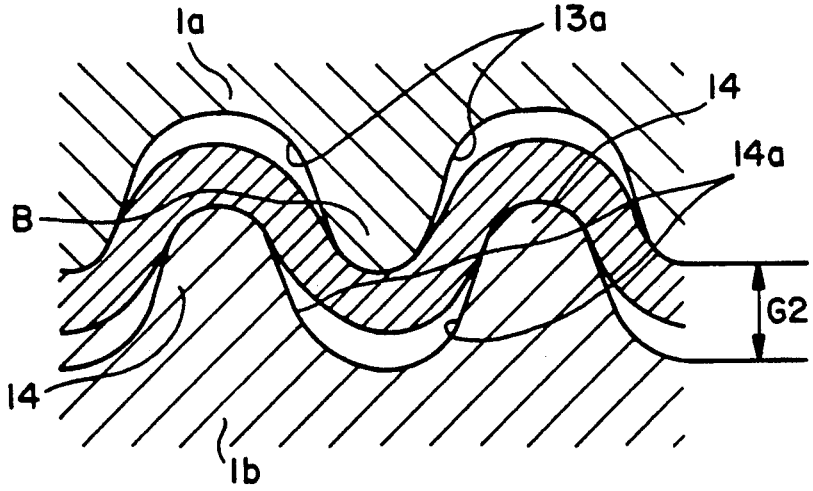
Figure 3C:
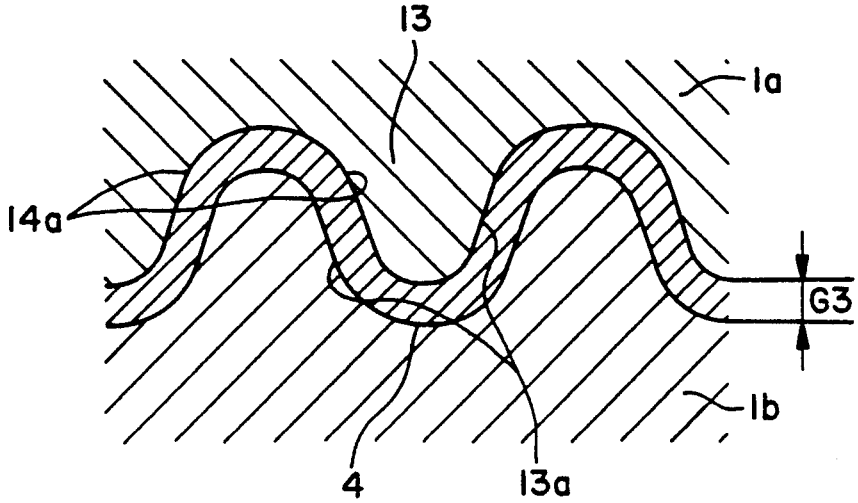

FIG. 3(*a*)–(*c*) show the manufacturing process of the strip 2 when a method of forming fins in this embodiment is employed. The relationship between cross-sectional shape of formed product 4 and the strip 2 in the forming process is shown in FIG. 3(*a*)–(*c*). A clearance G between the forming rollers 1*a* and 1*b* is also shown in FIG. 3(*a*)–(*c*). The clearance G is defined as a distance between a base portion of a protrusion of one roller and a top of a protrusion of the other roller. FIG. 3(*a*) shows the strip 2 is being sandwiched by the forming rollers 1*a* and 1*b*.

The clearance G is shown as G1 in FIG. 3(*a*). The strip 2 is slightly pressed a little into the depressions 12 and 15 by the protrusions 13 and 14, however, motion in the direction of the width of the strip 2 is restricted. FIG. 3(*b*) shows the condition when the clearance G1 between forming rollers 1*a* and 1*b* becomes a clearance G2, which is smaller than the clearance G. A part of the strip 2 is pressed in the direction of thickness of the strip 2 by side face portions 13*a* and 14*a* of the protrusions 13 and 14 so that a plastic flow is caused in the direction of the width of the strip 2.

FIG. 3(*c*) shows a later step in the process where the clearance G becomes a predetermined clearance G3, which is smaller than the clearance G2. The strip 2 is pressed in the direction of thickness of the strip 2 by the whole surface of a space formed between the side face portions 13*a* and 14*a* so that the plastic flow is completed.

Figure 4:
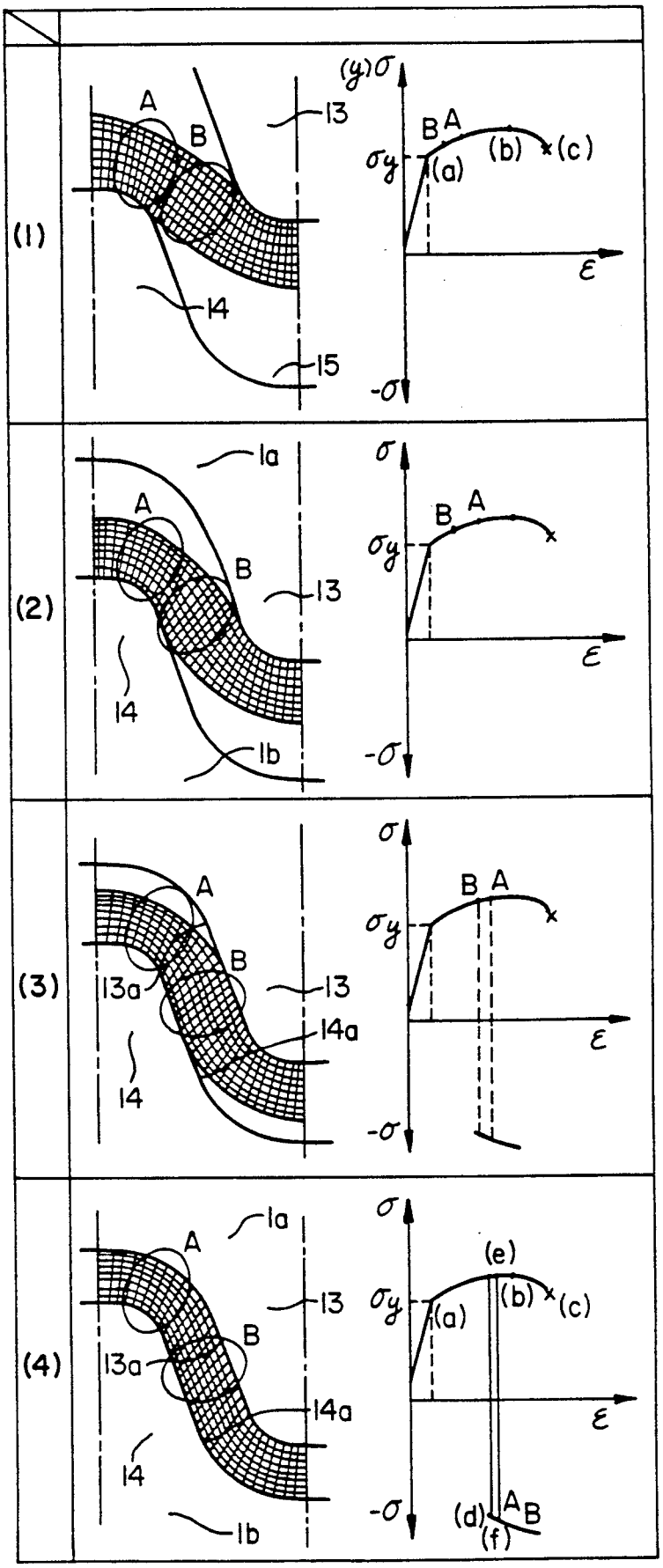
FIG. 4 is an illustration showing forming process of fins and corresponding graphs showing a relationship between stress and distortion.

FIG. 4(1)–(4) shows how the cross-section of the strip 2 changes when the strip 2 is in formation and further shows a diagram showing a relationship between stress and strain. The stress at the strip 2 becomes a state of biaxial stress consisting of a tensile stress in the direction of the width of the strip 2 and a compressive stress in the direction of thickness of the strip 2 when the side face portions 13*a* and 14*a* with the strip 2. Consequently, stress state is difficult to explain via a diagram showing a relationship between tensile stress and extentional strain. For convenience, the stress state is indicated with a curve showing a relationship between equivalent stress  and equivalent strain $\epsilon$. When the strip 2 is pushed a little bit into the depression 15 of the lower roller 1***b* by the protrusion 13 of the upper roller 1*a* as shown in FIG. 4(1). Each stress of portion A and portion B is between yield stress (*a*) and maximum stress (*b*). The stress of portion A is almost equal to the stress of portion B.

A breaking stress (*c*) is shown in FIG. 4(1). When the strip 2 is further pushed into the depression 15 as shown in FIG. 4(2), the portion A becomes thin and the portion B becomes inflated relatively so that a tensile stress of the portion A becomes larger than that of the portion B. When the strip 2 is pushed into almost the bottom of the depression 15 as shown in FIG. 4(3), the portion B is pressed and sandwiched by the side face portions 13*a* and 14*a* so that the tensile stress of the portion A is relaxed. Differences in tensile stress between the portions A and B therefore becomes small. When the strip 2 is completely pushed into a predetermined clearance between the upper roller 1*a* and the lower roller 1*b*, the portion B is strongly pressed by the side face portions 13*a* and 14*a* so that relative inflation of the portion B is completely removed. Material in the portion B flows plastically to the portion A. The stress at the portion B is on a line which is over yield stress (d) at compression. The stress at the portion A is on a line which is over yield point at a compression from a point of inflection (e). Consequently, the strip 2 keeps an accurate cross-sectional shape thereof without causing breakage. Since no stress stronger than maximum strength is added locally to the strip 2, the strip 2 does not break and is stable during the forming process. Consequently, the balance of stress in the strip 2 is good and a torsion of the strip 2 in the longitudinal direction is reduced.

Figure 5:
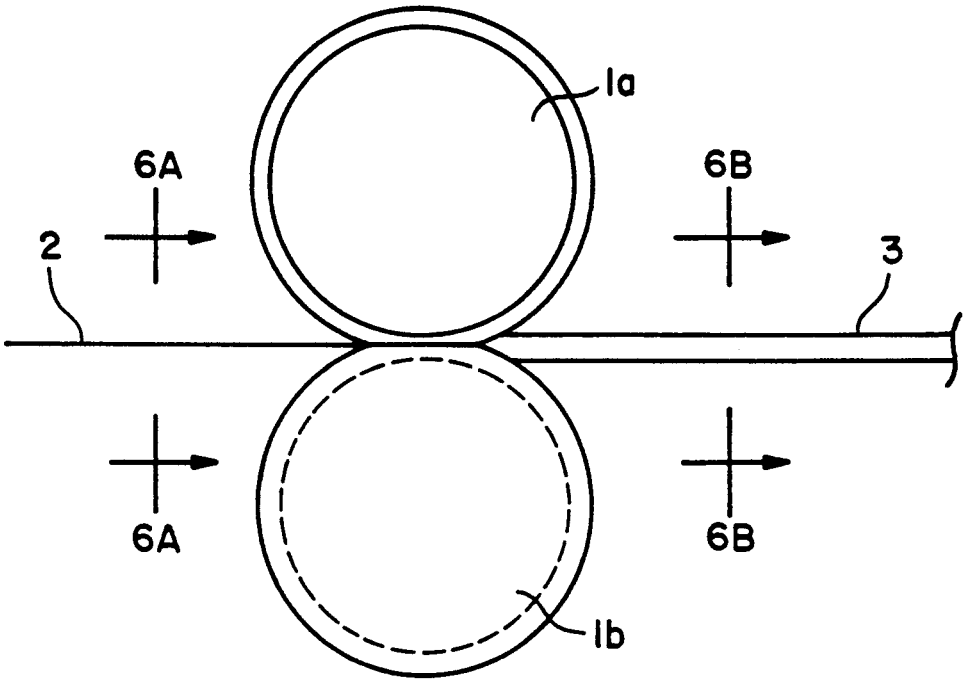
FIG. 5 is a side view of a forming product produced by fin-forming rollers.
Figure 6A:
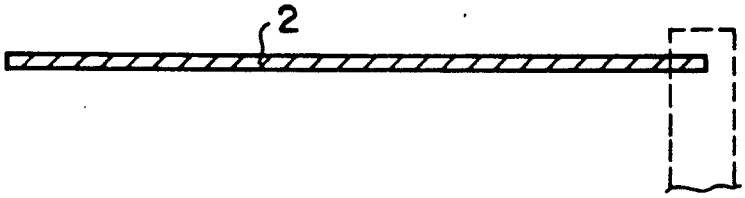
FIGS. 6A and 6B are cross-sectional views of material (strip) and forming product.
Figure 6B:
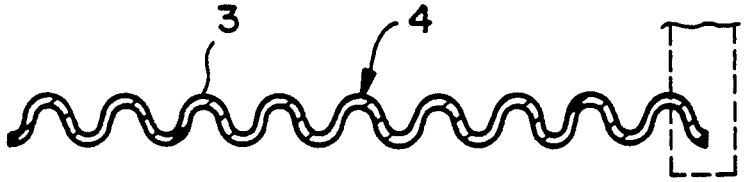

FIG. 5 is a side view of a forming process used by forming rollers 1*a* and 1*b*. The strip 2 is inserted between forming rollers 1*a* and 1*b*. The cross-section of the strip 2 is shown in FIG. 6(*a*). The product 4 is finally obtained after the process explained in detail in FIG. 4 has been completed. The product 4 has fins 3 shown in FIG. 6(*b*). The product 4 is thinner than the strip 2; the width, however, is almost equal. Top and bottom parts of FIG. 6, respectively show cross-sectional views taken on lines A—A and B—B of FIG. 5.

Figure 7:
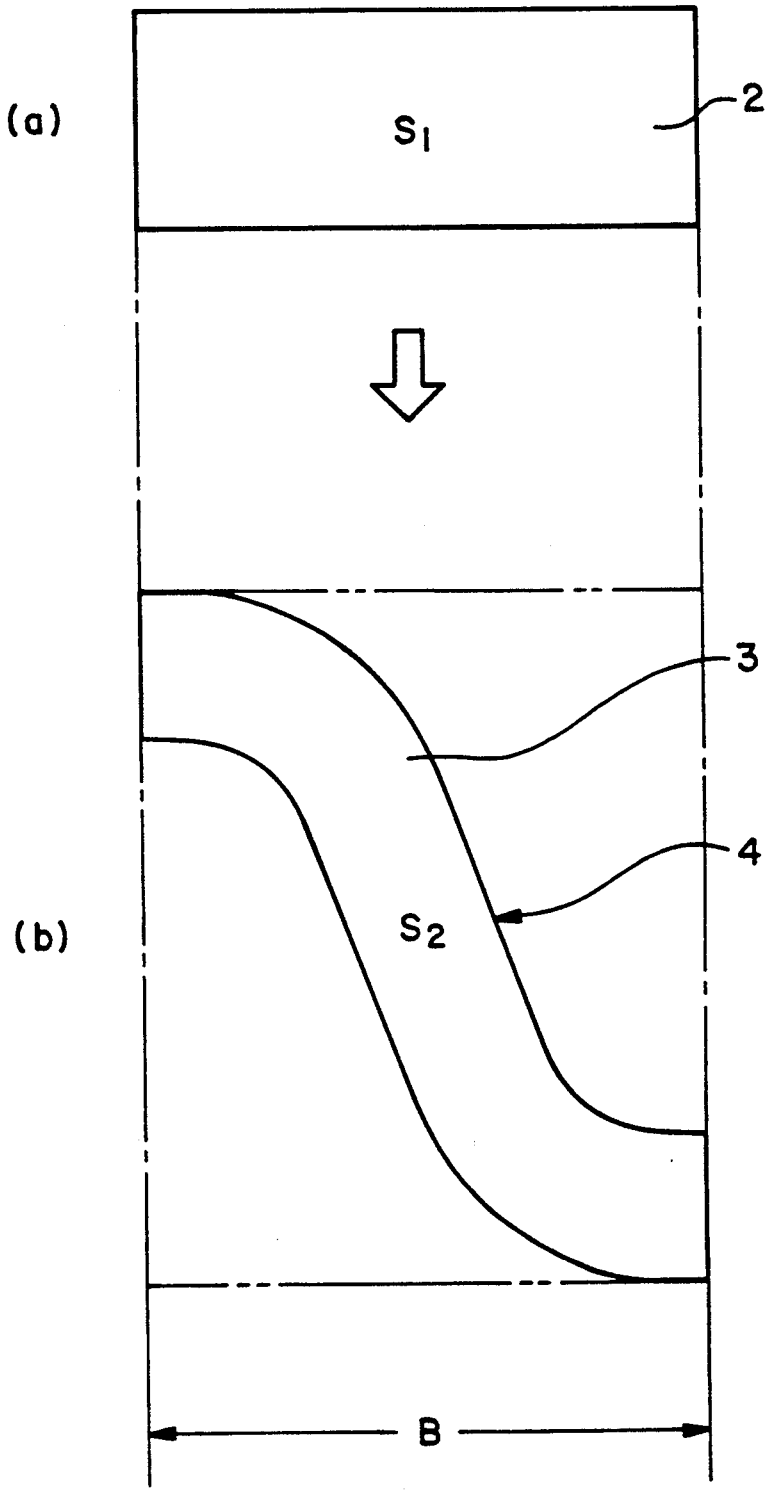
FIG. 7 is an enlarged view of dotted portion in FIG. 6.
Figure 8:
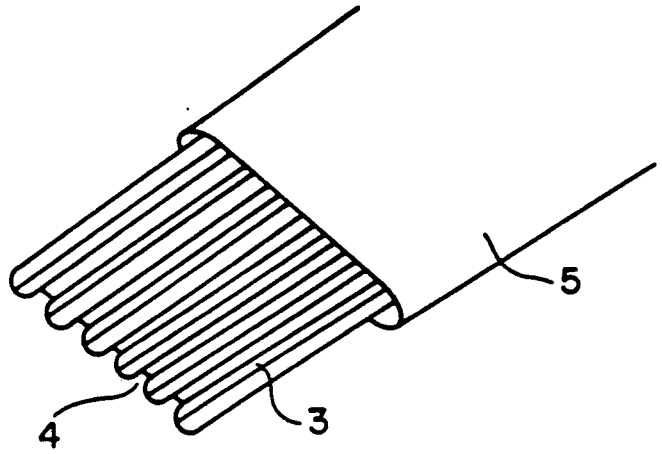
FIG. 8 is a perspective view showing fin strip inserted into a tube of a heat exchanger.

FIG. 7 shows enlarged dotted portion of FIG. 6. A cross-sectional area S1 of the strip 2 is almost the same as a cross-sectional area S2 of the product 4 when the same width B is preferred. The product 4 having fins 3 is inserted into a tube 5 of a heat exchanger shown in FIG. 8 and is brassed.

Figure 9:
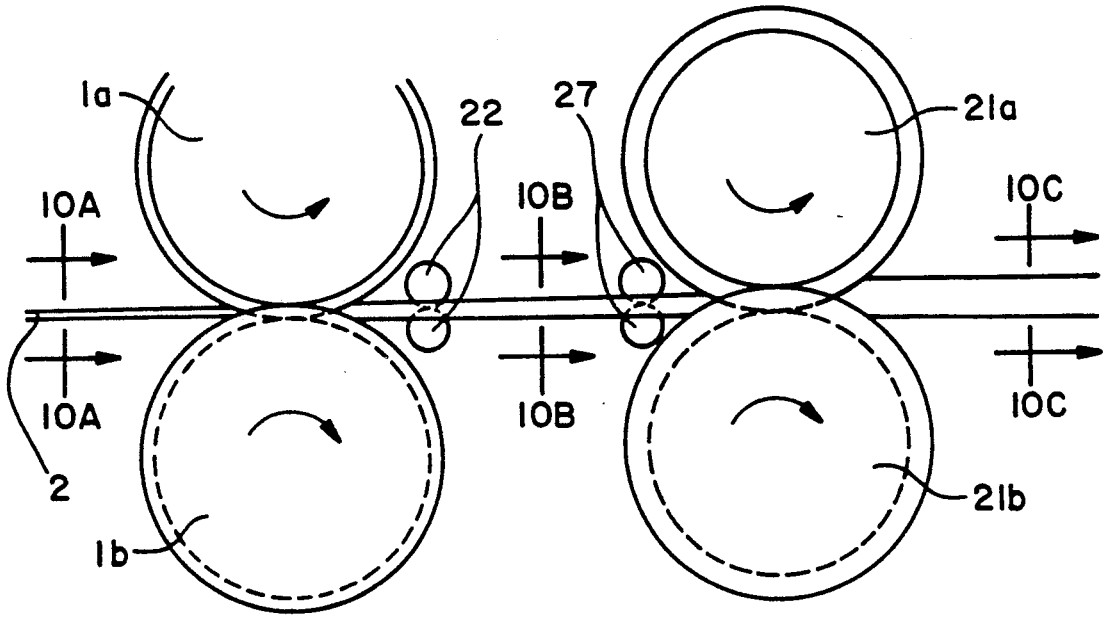
FIG. 9 is a side view of a forming product produced by forming rollers of the second embodiment.
Figure 10A:
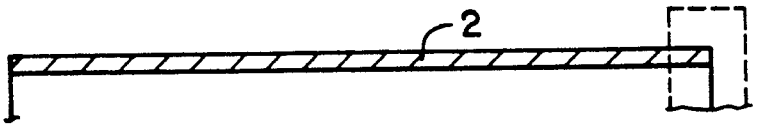
FIGS. 10A, 10B and 10C are cross-sectional views showing forming process for fins of the second embodiment.
Figure 10B:
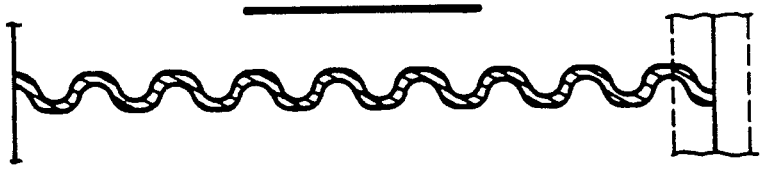
Figure 10C:
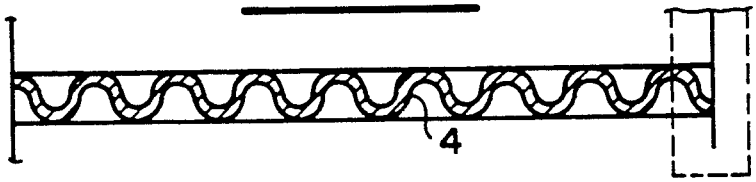

FIG. 9 shows a side view of the second embodiment. Two forming apparatus of the type in FIG. 1 are respectively disposed along the longitudinal direction of the strip 2. The rear forming apparatus which is to the right in FIG. 9, has an upper roller 21*a* and a lower roller 21*b*. A conveying roller 22 is disposed between the forming rollers 1*a* and 1*b*. Another conveying roller 27 is disposed between the forming rollers 21*a* and 21*b*. Consequently, the strip 2 is conveyed smoothly. The strip 2 is inserted from the left. The strip 2 is formed roughly by the forming rollers 1*a* and 1*b* as shown in FIG. 10(*b*). Further, the strip 2 is accurately formed by the forming rollers 21*a* and 21*b* as shown in FIG. 10(*c*). FIGS. 10(*a*), 10(*b*) and 10(*c*) show cross-sectional views taken on lines A—A, B—B and C—C of FIGS. 9 respectively.

Figure 11:
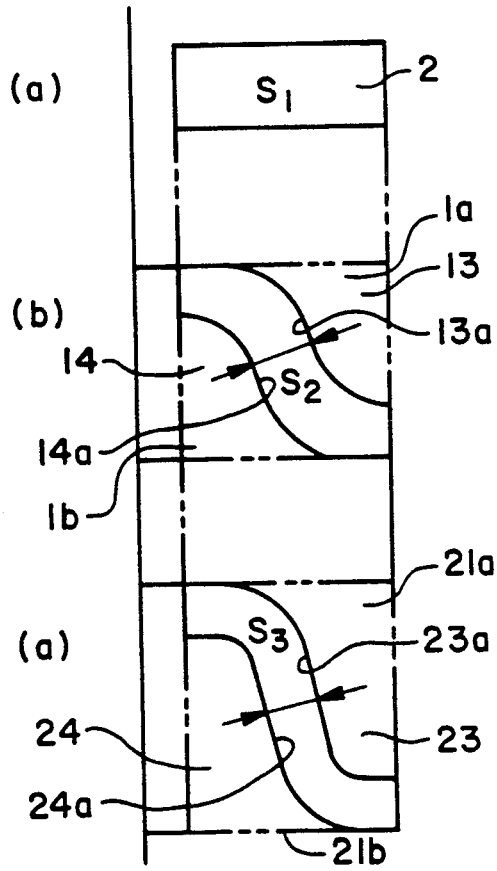
FIG. 11 is an enlarged view of dotted portion of FIG. 10.

FIG. 11 shows an enlarged dotted portion of FIG. 10. The strip 2 is formed roughly to form a fin shape as shown in FIG. 11(*b*) by the side face portions 13*a* and 14*a*. Further, the strip 2 is formed accurately by side face portions 23*a* and 24*a* of protrusions 23 and 24 of the forming rollers 21*a* and 21*b*. A thickness of the product also becomes thin in case of the second embodiment, however, cross-sectional areas S1, S2 and S3 are all almost equal.

Figure 12:
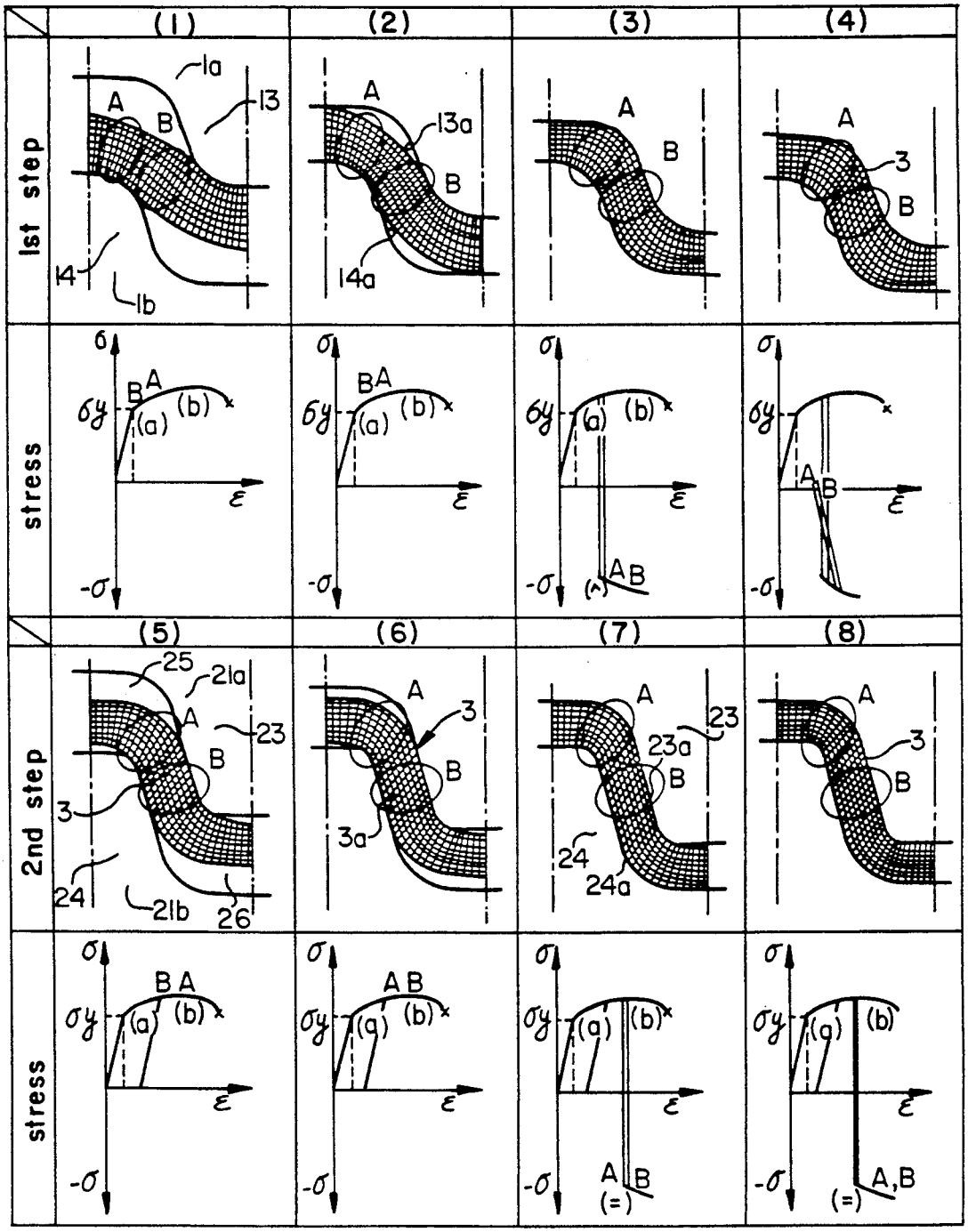
FIG. 12 is an illustration showing forming process of fins in the second embodiment and corresponding graphs showing a relationship between stress and distortion.
Figure 13:
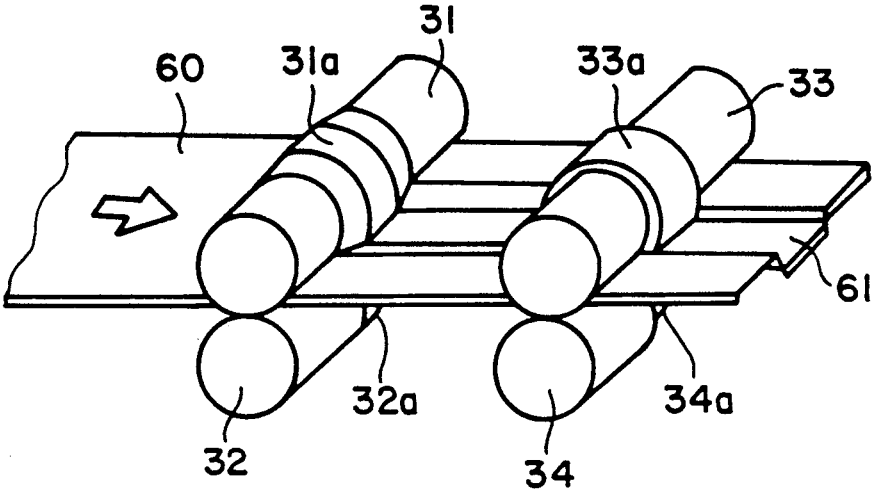
FIG. 13 is a perspective view showing conventional fin-forming rollers.
Figure 14:
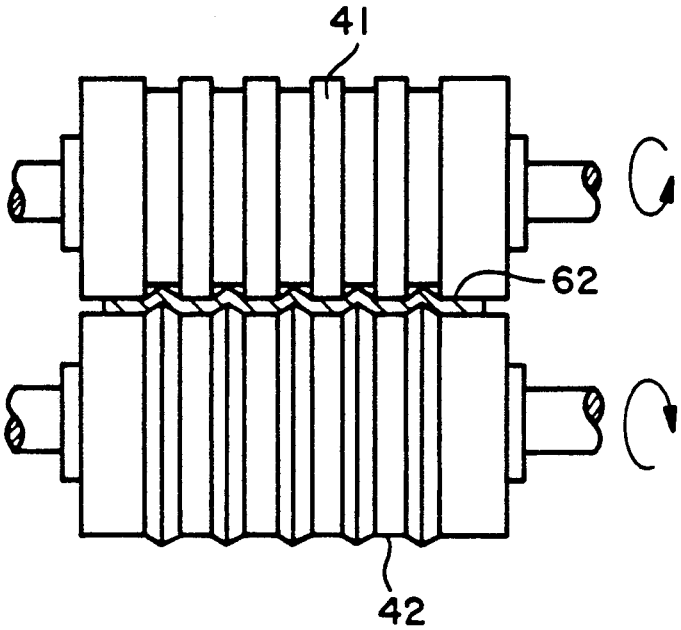
FIG. 14 is a perspective view showing another conventional fin-forming rollers.
Figure 15:
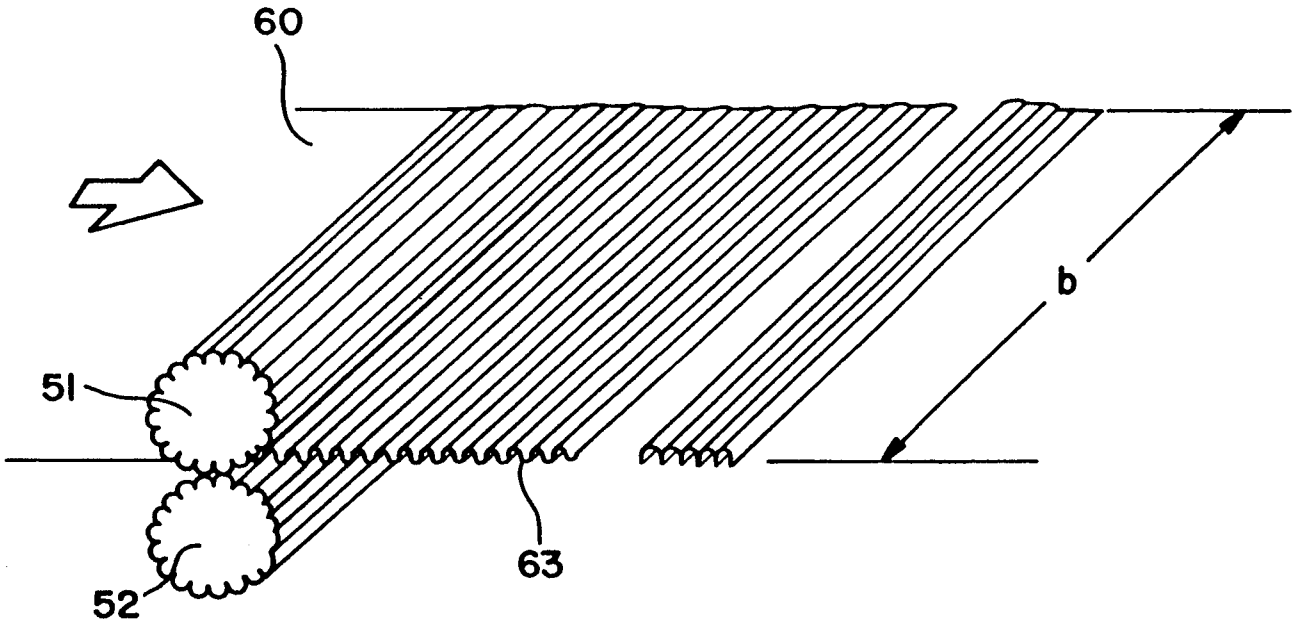
FIG. 15 is a perspective view showing the other conventional fin-forming rollers.

FIG. 12 is an explanatory view, similar to FIG. 4, showing processes including rough machining (the first step) and accurate machining (the second step). When the strip 2 is slightly pushed into the depression of the lower roller 1*b* by the upper roller 1*a* as shown in (1) of the first step, each stress of the portion A and the portion B is between yield point 9*a*) and maximum stress (*b*). A tensile stress of the portion A is a little larger than that of the portion B. (C) shows a breaking stress. When the strip 2 is further pushed into a depression as shown in (2) of the first step, the portion A becomes thin and the portion B becomes relatively inflated. Consequently, a difference in stress between the portion A and the portion B becomes large. When the strip 2 is pushed into the bottom of a depression of the lower roller 1*b* as shown (3) of the first step, the portion B is pressed and sandwiched by the side face portions Ba of the upper roller 1*a* and 14*a* of the lower roller 1*b* s that the stresses of the portions A and B are dramatically changed and are on a line which is over the yield stress (*c*) at compression. Relative inflation of the portion B is relaxed so that differences of stress between the portions A and B are reduced. When a load is released as shown in (4) of the first step, the strain of the portions A and B return a little because of the amount of elasticity In the second step, the stress of each portion in fin 3 converges to one balanced value after releasing the load at the first step. Strictly speaking, the value is not zero, however, the stress is considered to be zero for convenience of explaining a hysteresis showing stress and strain at the second step. When a protrusion 23 of the forming roller 21*a* mates at a certain degree with an intrusion 26 of the forming roller 21*b* as shown in (5) of the second step, each stress of the portions A and B exist on a line between yield point (*a*) and maximum stress (*b*). A tensile stress of the portion A is a little bit larger than that of the portion B. When the protrusion 23 further mates with the intrusion 26 as shown in (6) of the second step, an inclination portion 3*a* of fin 3 is actively pressed by the protrusions 23 and 24 in the direction of thickness of the strip 2 so that material flows plastically from the portion B to the portion A. When a clearance between the protrusions 23 and 24 is almost filled with fin 3 as shown in (7) of the second step, the stress of the portions A and B dramatically changes from a tensile stress to compressive stress. When the steps are completed as shown in (8) of the second step, each stress of the portions A and B exist on a line over the yield point (d) at compression.

As a result, the strip 2 keeps an accurate shape of cross-sectional shape without causing a constriction or breakage. Further, since no stress stronger than maximum strength is added locally to the strip 2, it is stable during the forming process. Consequently, the balance of stress in the strip 2 is good and a torsion of the strip 2 in the longitudinal direction is reduced.

The preferred shape used to match a center of a corrugated fin formed at the first step with a corrugated portion of forming roller at the second step uses a shape of conveying rollers 22 and 27 designed like a ball of a Japanese abacus.

Although only a few embodiments have been described in detail above, those having ordinary skill in the art will certainly understand that many modifications are possible in the preferred embodiment without departing from the teachings thereof.

All such modifications are intended to be encompassed within the following claims.

What is claimed is:

1. A method of forming corrugated fins, comprising the steps of:

inserting a strip between a pair of forming dies having a line of protrusions; and forming corrugated fins including a first convex bent portion, a second concave bent portion and a straight portion which continuously connects said first and second bent portions, said forming step including:

first pressing portions of said strip using said protrusions of said forming dies to form depressions at said portions which causes said strip to become thicker at said straight portions and thinner at portions other than the straight portions; and second pressing, using side face portions of the forming dies, said straight portion in a direction of its thickness with a stress amount between yield point and maximum stress of said strips, to reduce a thickness at said straight portion and make uniform the thickness throughout a whole of said corrugated fin so that said straight portion is plastically deformed toward both first and second bent portion and said corrugated fins have the same cross-sectional area per unit length of cross section, before and after forming said corrugated fins.

2. A method of forming corrugated fins according to claim 1, wherein said pressing step uses a pair of forming rollers having a line of protrusions protruding radially on the periphery of said rollers respectively as said forming dies and said line of protrusions of one roller mates with said line of protrusions of the other roller.

3. A method of forming corrugated fins according to claim 2, comprising the further step of adjusting a clearance said pair of forming rollers which are movably disposed to adjust a clearance between a line of protrusions of one roller and a line of protrusions of the other roller.

4. A method of forming corrugated fins according to claim 1, wherein said strip is made from aluminum alloy.

5. A method of forming corrugated fins according to claim 1, comprising the further step of reducing thickness of said strip when said strip is pressed in the direction f the strip thickness.

6. A method of forming corrugated fins according to claim 1, comprising the further step of disposing said corrugated fins into a tube of a heat exchanger as inner fins.

7. A method of forming corrugated fins according to claim 2, wherein said pressing step uses two pairs of forming rollers as said pair of forming dies.

8. A method of forming corrugated fins according to claim 1, comprising the further step of equaling cross-sectional area of said strip per the unit length before and after forming corrugated fins.

9. A method of forming corrugated fins according to claim 1, comprising the step of reducing the thickness of said strip at said bent portions and later reducing the thickness of said strip at said straight portion.

10. An apparatus for forming corrugated fins comprising:

a pair of forming dies having a line of protrusions which are shaped to form said corrugated fins including a first bent portion which is bent in a convex shape, a second bent portion which is bent in a concave shape, and a straight portion which connects said first and second bent portions continuously; and a means for inserting a strip between said pair of forming dies; and a means for pressing said strip between said forming dies;

wherein said forming dies include first pressing means which press said strip using said protrusions of said forming dies to form depressions at first portions of said strip and which causes said strip to become thicker at said straight portions and thinner at portions other than the straight portions, and second pressing means which press said straight portion in the direction of the thickness thereof with a stress amount between yield stress and maximum stress of said strip to reduce the thickness at said straight portion and make uniform the thickness throughout said corrugated fin so that said straight portion is plastically deformed toward both first and second bent portions, and said corrugated fins have the same cross-sectional area per unit length before and after forming corrugated fins.

11. An apparatus for forming corrugated fins according to claim 10 wherein said forming dies are a pair of forming rollers having a line of protrusions protruding radially on the periphery of said rollers respectively and said line of protrusions of one roller mates with said line of protrusions of the other roller.

12. An apparatus for forming corrugated fins according to claim 11, further comprising:

a means for adjusting a clearance of said pair of forming rollers, which are movably disposed to adjust a clearance between a line of protrusions of one roller and a line of protrusions of the other roller.

* * * * *